US010180021B1

(12) United States Patent
Benzel

(10) Patent No.: US 10,180,021 B1
(45) Date of Patent: Jan. 15, 2019

(54) SECURITY DEVICE

(71) Applicant: Daryl Benzel, Louisville, KY (US)

(72) Inventor: Daryl Benzel, Louisville, KY (US)

(73) Assignee: INVINCIBOLT LOCKS LLC, Louisville, KY (US)

( * ) Notice: Subject to any disclaimer, the term of this patent is extended or adjusted under 35 U.S.C. 154(b) by 0 days.

(21) Appl. No.: 15/618,742

(22) Filed: Jun. 9, 2017

(51) Int. Cl.

| | |
|---|---|
| ***E05C 1/00*** | (2006.01) |
| ***E05C 1/06*** | (2006.01) |
| ***E05B 63/00*** | (2006.01) |
| ***E05B 15/02*** | (2006.01) |

(52) U.S. Cl.
CPC ..... *E05C 1/06* (2013.01); *E05B 15/02* (2013.01); *E05B 63/0017* (2013.01)

(58) Field of Classification Search
CPC ..... E05C 1/06; E05B 15/02; E05B 63/0017
USPC ..... 79/129, 134, 190
See application file for complete search history.

(56) References Cited

U.S. PATENT DOCUMENTS 845,613 A * 2/1907 Caldwell ..... E05B 63/0017 70/129
1,330,650 A * 2/1920 Pehel ..... E05B 63/0017 70/134
1,373,353 A * 3/1921 Roden ..... E05B 63/122 70/104
1,383,128 A * 6/1921 Larsen ..... E05B 63/0017 70/134
1,387,187 A 8/1921 Segal
1,530,671 A 3/1925 Hoffman
1,699,370 A * 1/1929 Menzel ..... E05B 63/0017 70/129
1,813,240 A 7/1931 Joseph
1,894,913 A 1/1933 Sadler
2,468,406 A * 4/1949 Mora ..... E05C 1/04 292/153
3,175,376 A * 3/1965 Cantwell ..... E05B 17/042 292/140
3,464,242 A * 9/1969 Sakuzo ..... E05B 63/0021 70/134
3,851,325 A * 11/1974 Maged ..... E05B 45/12 200/61.68
4,248,068 A * 2/1981 Esser ..... E05B 63/0017 292/142
4,300,793 A 11/1981 Benzel, Jr.
4,313,320 A * 2/1982 Best ..... E05B 63/0017 292/92
4,483,162 A * 11/1984 Dunphy ..... E05B 63/0017 292/142
4,502,716 A * 3/1985 Tsai ..... E05B 63/0017 292/142
4,606,203 A * 8/1986 Esser ..... E05B 59/00 292/34
4,682,482 A * 7/1987 Hall ..... E05B 63/0017 292/153

(Continued)

OTHER PUBLICATIONS

U.S. Appl. No. 14/795,918, filed Jul. 10, 2015.

*Primary Examiner* — Suzanne L Barrett
(74) *Attorney, Agent, or Firm* — Wyatt, Tarrant & Combs, LLP; Matthew A. Williams; Max E. Bridges

(57) ABSTRACT

A security device for a door comprising a housing, a turn knob actuator, a key lock actuator, and a deadbolt that slides into and out of an opening in the door frame located forward of the front face of the door, where the door frame is usually thick and solid.

12 Claims, 11 Drawing Sheets

(56) References Cited

U.S. PATENT DOCUMENTS

| | | | | | |
|---|---|---|---|---|---|
| D318,411 | S * | 7/1991 | McKernan | D8/346 | |
| 5,257,837 | A * | 11/1993 | Bishop | E05B 63/06 | 292/1.5 |
| 5,265,452 | A * | 11/1993 | Dawson | E05B 17/042 | 292/142 |
| 6,374,650 | B1 * | 4/2002 | Newman | E05B 17/042 | 70/102 |
| 6,449,995 | B1 * | 9/2002 | Paolini | E05B 43/00 | 70/124 |
| 6,883,357 | B1 * | 4/2005 | Cheng | E05B 41/00 | 292/251.5 |
| 7,334,439 | B2 * | 2/2008 | Ruan | E05B 9/082 | 292/336.3 |
| 8,001,813 | B1 * | 8/2011 | Turnbo | E05B 63/0017 | 292/139 |
| 2004/0066046 | A1 * | 4/2004 | Becken | E05B 63/20 | 292/39 |
| 2005/0039504 | A1 * | 2/2005 | Smith | E05B 13/00 | 70/134 |
| 2006/0065025 | A1 * | 3/2006 | Viviano | E05B 55/005 | 70/134 |
| 2006/0179904 | A1 * | 8/2006 | Shen | E05B 63/0004 | 70/370 |

* cited by examiner

SECURITY DEVICE

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

The present invention relates to a security device to secure a door. There are many problems with people breaking into buildings, even when the doors are locked. They may use a battering ram or a pry bar to disengage the lock. Most locks are installed in-line with the edge of the door, in an area of the building framework that is relatively shallow and weak, which makes it easy to disengage the lock using a battering ram or pry bar.

SUMMARY OF THE INVENTION

The present invention provides a security device which includes a deadbolt for sliding into and out of an opening in the door frame located forward of the front face of the door, where the door frame has greater structural integrity than at the usual position for a deadbolt lock that is aligned with the side edge of the door. Typically, this area of the door frame includes at least two two-by-four pieces of lumber abutting each other. The deadbolt secures into a ferrule which is inserted into the door frame and abuts the inner surface of the door. In this particular embodiment, the deadbolt may be engaged by a turn knob and/or a key.

BRIEF DESCRIPTION OF THE DRAWINGS

For a further understanding of the nature, objects, and advantages of the present invention, reference should be had to the following detailed description, read in conjunction with the attached figures, wherein like reference numerals denote like elements and wherein.

DETAILED DESCRIPTION OF THE INVENTION

The present invention relates to a security device which includes a deadbolt for sliding into and out of an opening in the door frame located forward of the front face of the door, where the door frame has greater structural integrity than at the usual position for a deadlock that is aligned with the side edge of the door. More specifically, the invention utilizes a ferrule that is inserted into the opening in the door frame and secured to the frame using screws. The security device secures to the door and the deadbolt slides into and out of the ferrule.

Figure 1:
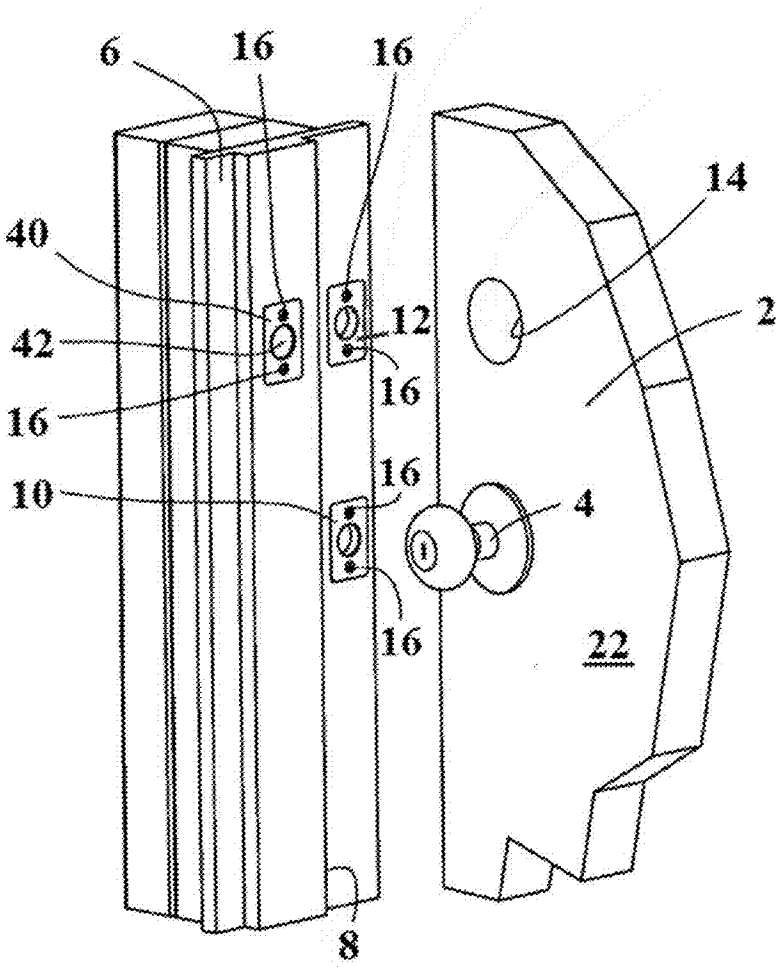
FIG. 1 is a broken-away, perspective view of the outside of a door and frame with a door knob having a standard cylinder lock and showing an opening for the installation of a deadbolt lock above the door knob.

FIG. 1 shows a conventional door 2 including standard door knob 4 with a cylinder lock. The door 2 also defines a through opening 14 above door knob 4, which is normally used for the installation of a deadbolt lock. The door 2 is mounted on door frame 6 by means of standard hinges (not shown). The door frame 6 includes lower strike plate 10 corresponding to door knob 4 and cylinder lock, as well as upper strike plate 12 corresponding to through opening 14 and deadbolt lock (not shown). When door 2 is closed, it abuts stop surface 8. Upper strike plate 12 and lower strike plate 10 are located backwardly of stop surface 8 aligned with side edge of door 2, when the door 2 is closed. Two screws 16 each hold strike plates 10, 12 in place.

FIG. 1 also shows ferrule 40 mounted forward of stop surface 8, and forward of outside door surface 22, when door 2 is closed, the purpose of which is described below. Two screws 16 each secure ferrule 40 in place to door frame 6.

FIGS. 2 through 9 show door 2 mounted on door frame 6, with an exemplary embodiment of security device 20 installed in through opening 14 (see FIG. 1). Door 2 has outside door surface 22 and inside door surface 24, and as indicated earlier, door 2 defines through opening 14 for the installation of a deadbolt lock (not shown). In this embodiment, security device 20 is installed in through opening 14.

Figure 14:
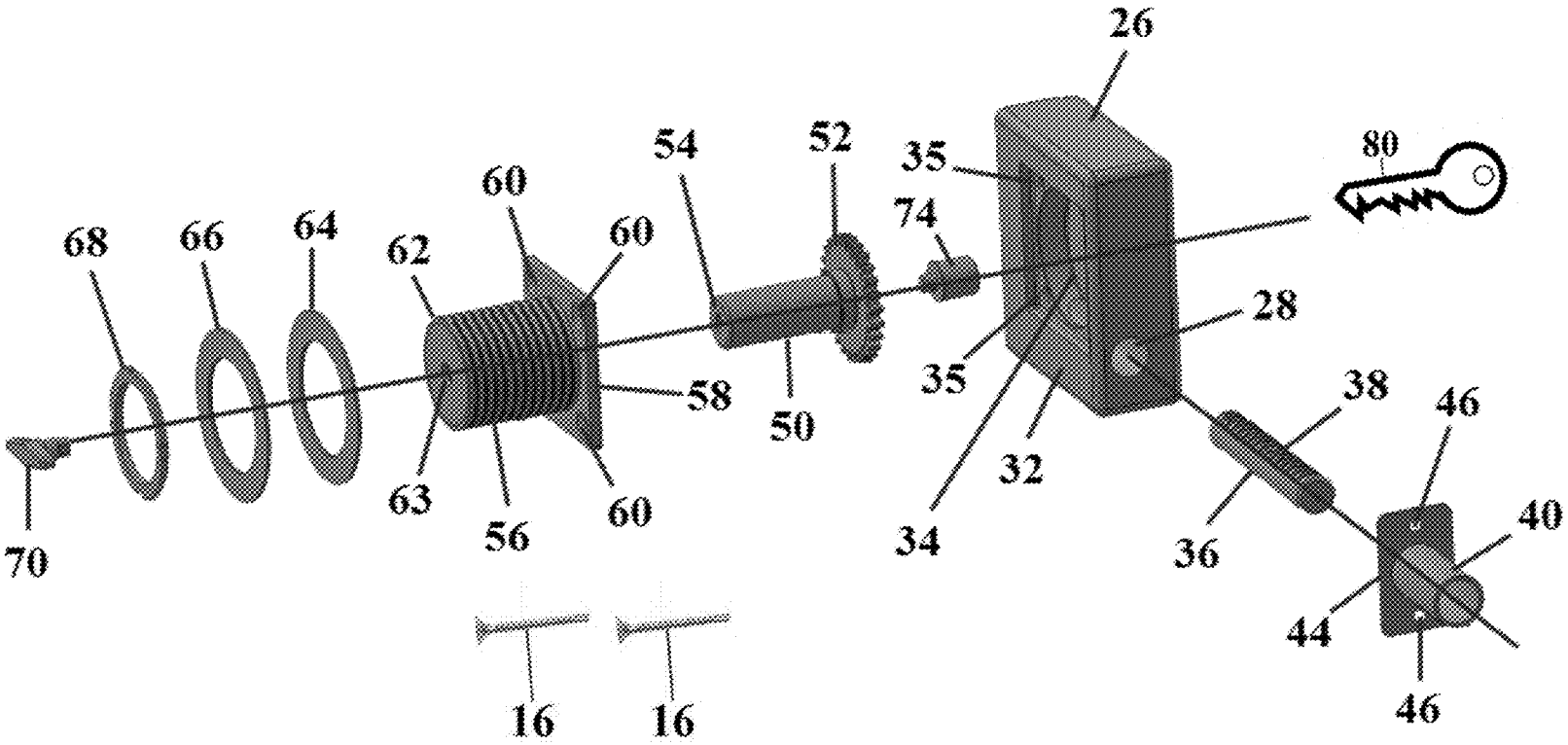
FIG. 14 is an exploded view of an exemplary embodiment of the present invention.

Referring now to FIG. 14, an exemplary embodiment of security device 20 includes housing 26 and deadbolt 36, which projects outwardly through bolt opening 28 and into ferrule 40. Ferrule 40 is inserted into ferrule opening 42 that is drilled into door frame 6 during the installation process, as described below. Ferrule flange 44 defines ferrule screw holes 46 to secure ferrule 40 to door frame 6 using screws 16.

Deadbolt 36 is inserted through bolt opening 28 into housing 26. Key cylinder 74 is inserted into housing opening 34 and engages outside housing face 32. Gear assembly 50 is then inserted into housing opening 34 until gear assembly 50 engages key cylinder 74 and teeth 52 of gear assembly 50 engage bolt notches 38. Gear assembly 50 extends through housing opening 34. Gear assembly housing 56 is then inserted over gear assembly end 54. Gear assembly housing flange 58 defines gear assembly flange holes 60 to secure gear assembly housing 56 to housing 26 using screws 16.

Figure 12:
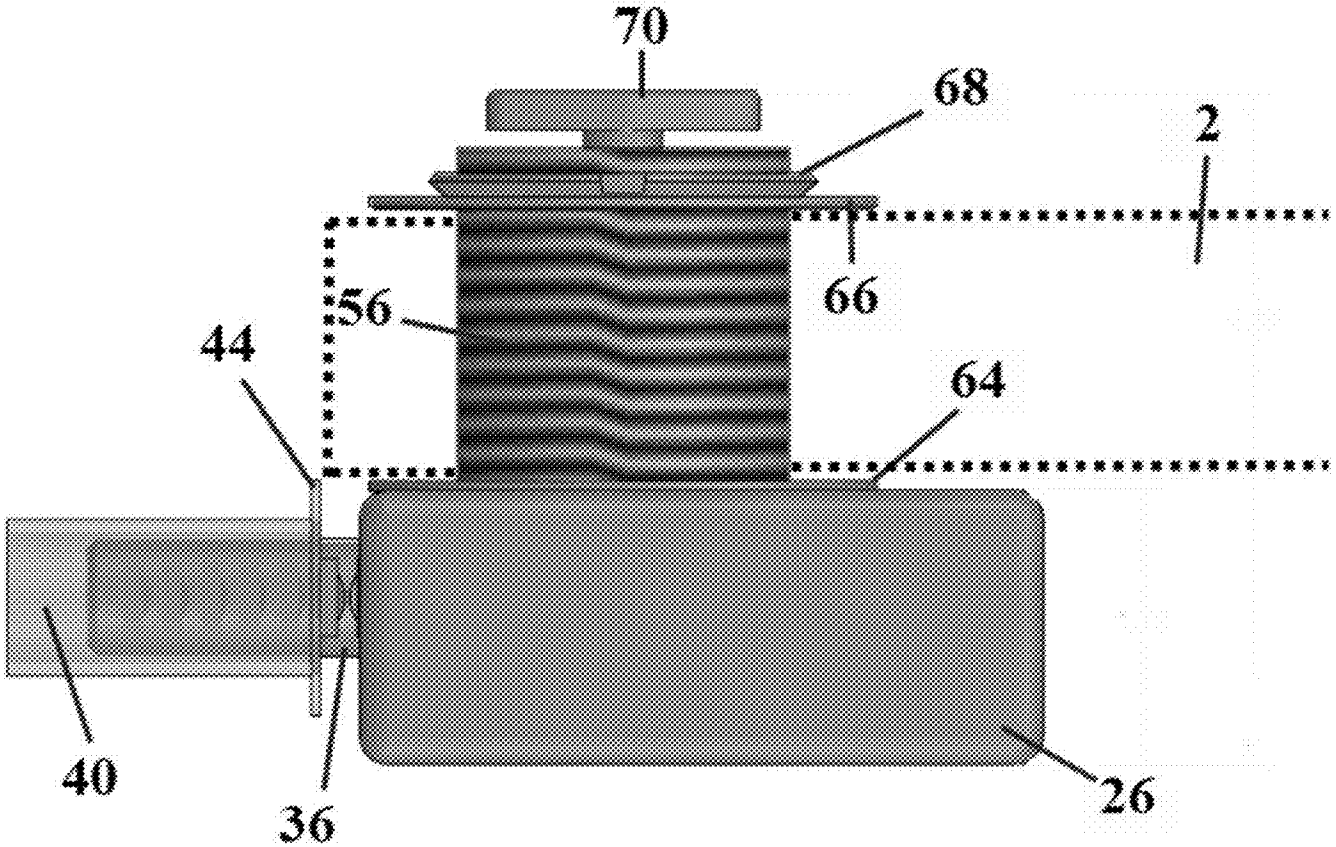
FIG. 12 a top, detail view of an exemplary embodiment of the present invention.
Figure 13:
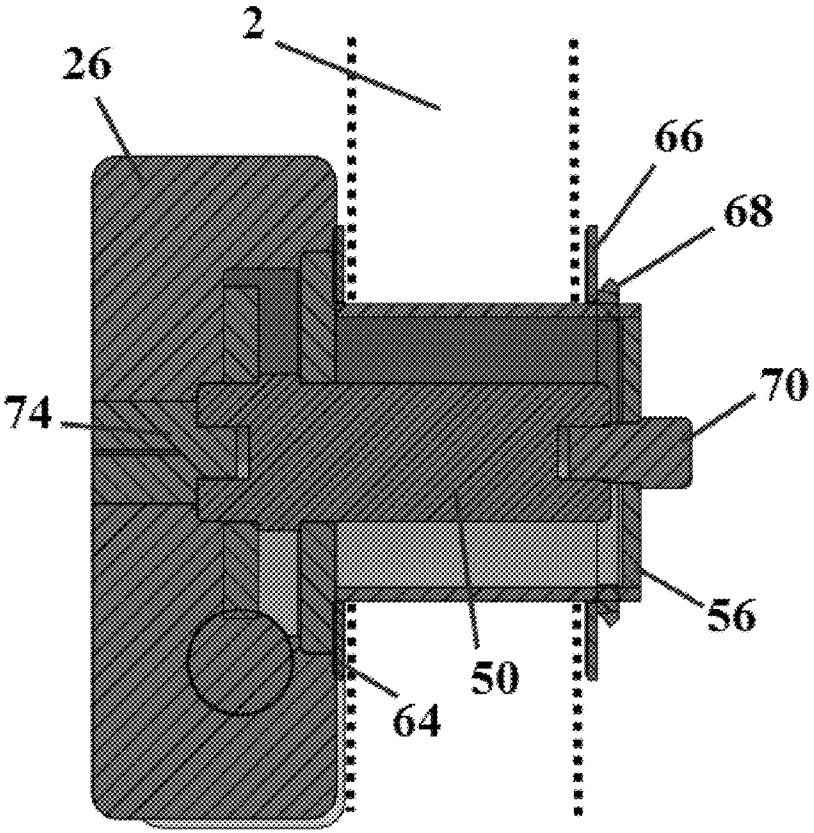
FIG. 13 is a top cross-section view of an exemplary embodiment of the present invention.

As shown in FIGS. 12 and 13, inner washer 64 slides over gear assembly housing end 62 and engages inner housing face 30. Outer washer 66 engages gear assembly housing end 62. Threaded ring 68 engages both outer washer 66 and gear assembling housing end 62. Turn knob 70 extends through knob hole 63 and engages gear assembly end 54.

In this embodiment, deadbolt 36 is actuated from the inside side of door 2 using turn knob actuator 72, which is mounted to gear assembly housing 56 and engages gear assembly 50. When turn knob 70 is rotated from the inside, turn knob 70 engages gear assembly end 54, turns gear assembly teeth 52, and deadbolt 36 slides into ferrule 40. To unlock security device 20, turn knob 70 is rotated the other direction, turn knob 70 engages gear assembly end 54, turns gear assembly teeth 52, and deadbolt 36 slides out of ferrule 40.

In this embodiment, deadbolt 36 is actuated from the outside side of door 2 using key 80. When key 80 is inserted into key hole 78 and rotated from the outside, key 80 engages key cylinder 74 which in turn rotates gear assembly teeth 52, and deadbolt 36 slides into ferrule 40. To unlock security device 20 from the outside, key 80 is rotated the other direction, key cylinder 74 engages gear assembly 50, turns gear assembly teeth 52, and deadbolt 36 slides out of ferrule 40.

Figure 5:
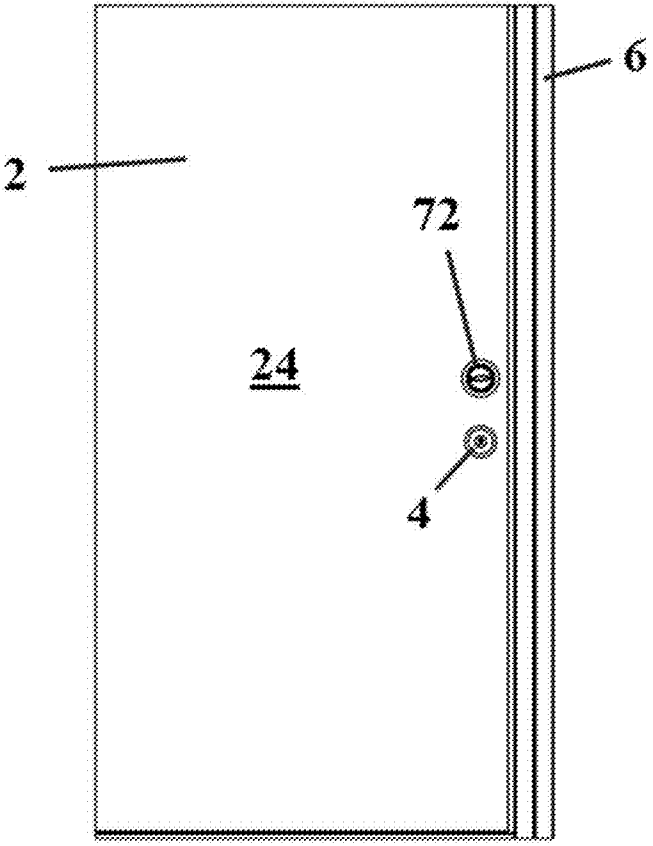
FIG. 5 is a broken-away, inside perspective of the door, frame, and an exemplary embodiment of the present invention from FIG. 2.
Figure 7:
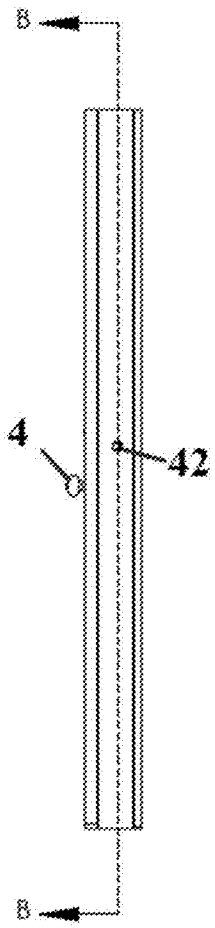
FIG. 7 is a broken-away, side view of the door and frame from FIG. 2.
Figure 9:
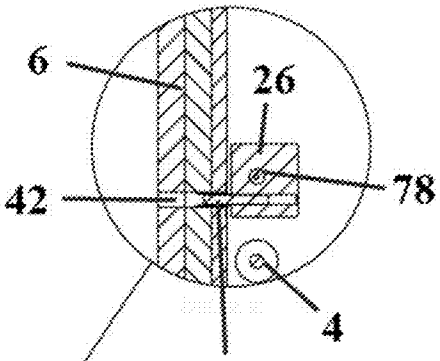
FIG. 9 is a detail view of an exemplary embodiment of the present invention from FIG. 8.
Figure 8:
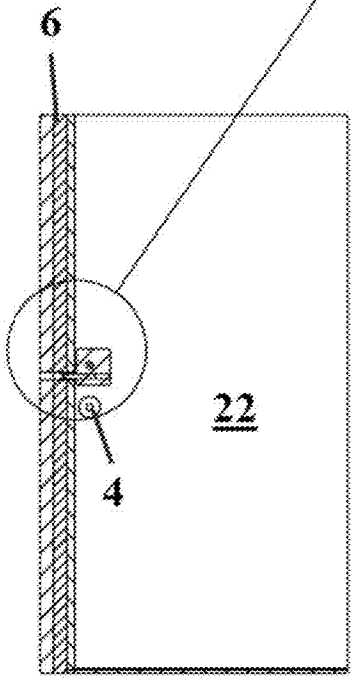
FIG. 8 is another broken-away, outside perspective view, partially in section, of the door, frame, and an exemplary embodiment of the present invention from FIG. 2.
Figure 10:
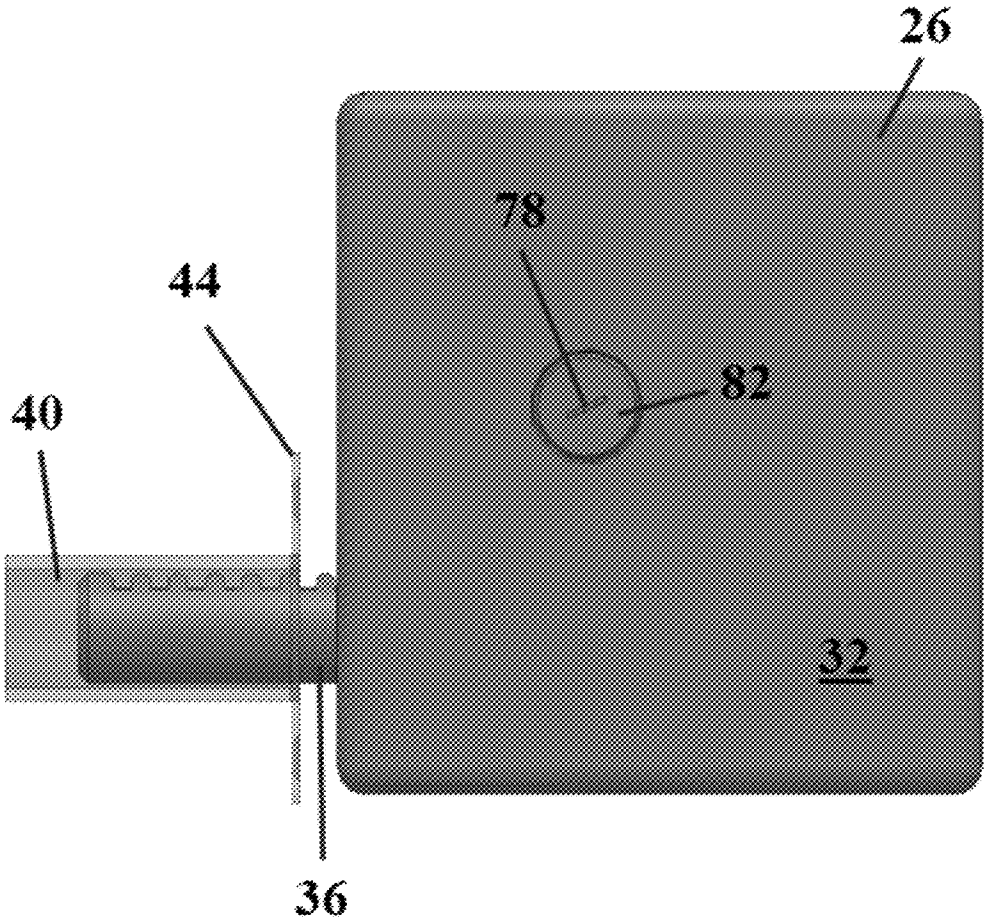
FIG. 10 is an outside, detail view of an exemplary embodiment of the present invention.
Figure 11:
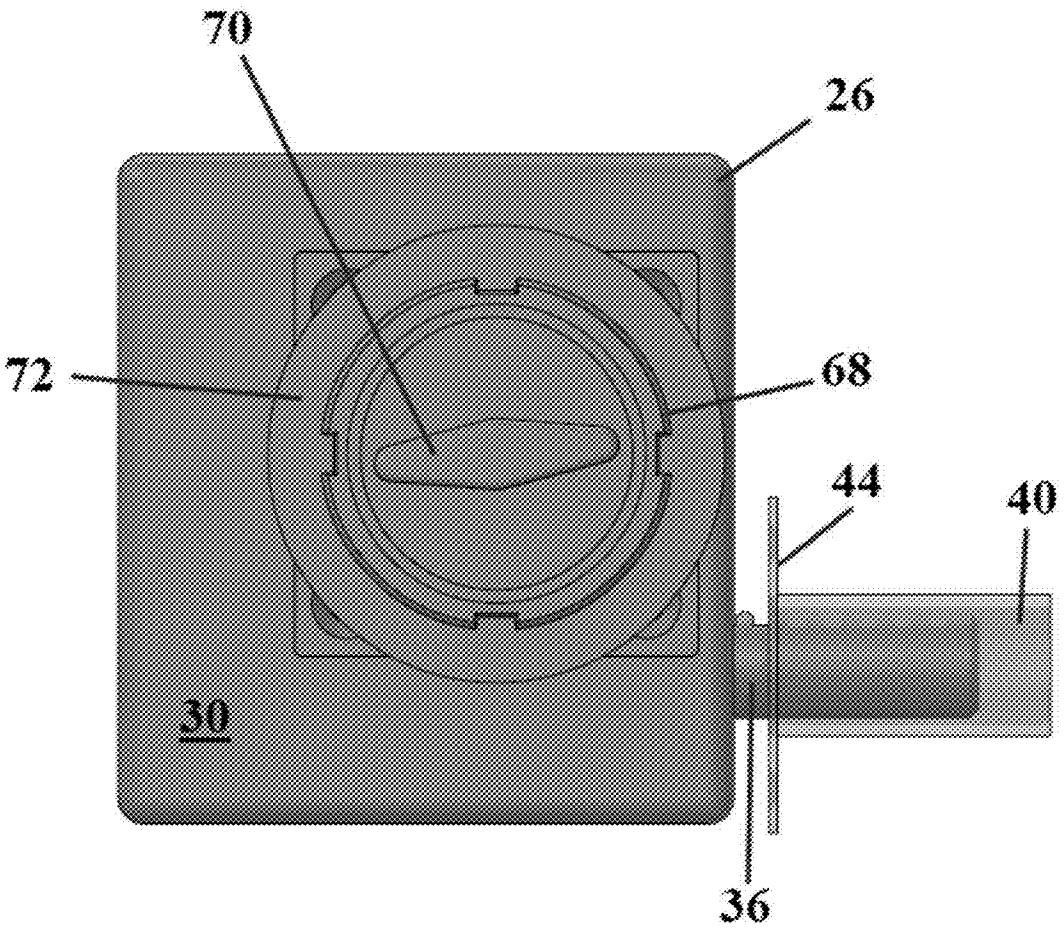
FIG. 11 is an inside, detail view of an exemplary embodiment of the present invention.

As best illustrated in FIGS. 8-12, deadbolt 36 engages ferrule 40 when in the locked position. As shown in FIGS. 8-10, when deadbolt 36 is actuated from the outside, key 80 inserts into key hole 78, key 80 rotates, and deadbolt 36 slides into and out of ferrule 40. As shown in FIG. 5, and FIGS. 11 and 12, when deadbolt 36 is actuated from the inside, turn knob 70 rotates and deadbolt 36 slides into and out of ferrule 40.

Prior to installation of security device 20, security device 20 is pre-assembled as described below. To install the pre-assembled security device 20 onto door 2 and door frame 6, gear assembly housing 56 is inserted into through opening 14 in door 2 such that inner housing face 30 and inner washer 64 abut outside door surface 22, and gear assembly housing 56 projects inwardly from door 2. Outer washer 66 is mounted over gear assembly end 54 and engages inside door surface 24, followed by threaded ring 68 and turn knob 70. Threaded ring 68 secures turn knob actuator 72 to housing 26. Once key lock actuator 82 and deadbolt 36 are installed, rotating key 80 actuates deadbolt 36. Once turn knob actuator 72 and deadbolt 36 are installed, rotating turn knob 70 actuates deadbolt 36.

Figure 2:
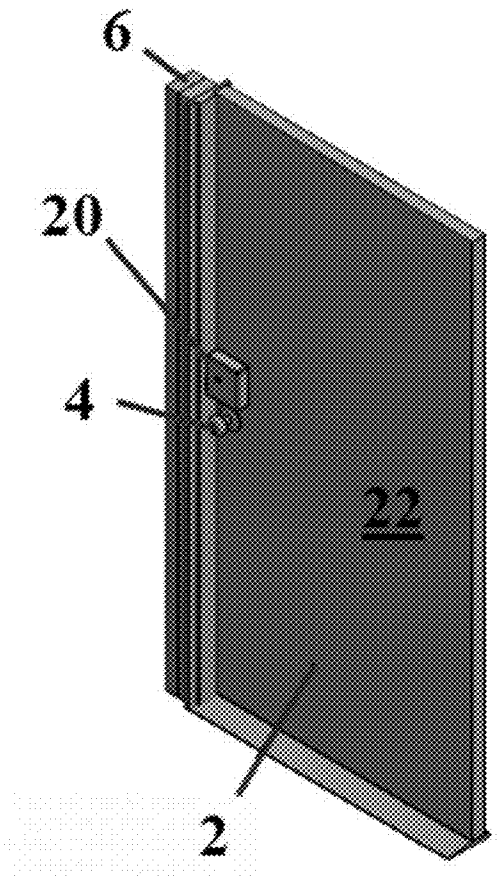
FIG. 2 is a broken-away, perspective view of the outside of the door and frame of FIG. 1 after the door knob is installed on the door, with an exemplary embodiment of the present invention installed in the deadbolt lock opening.
Figure 3:
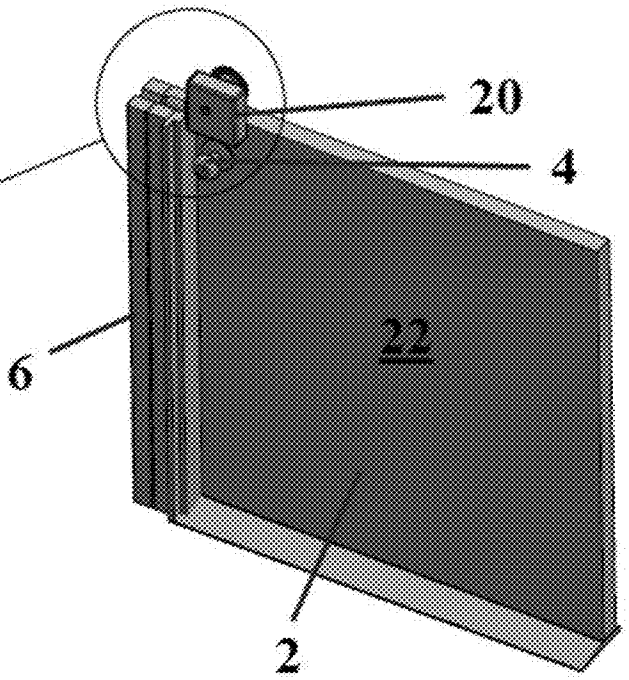
FIG. 3 is a broken-away, outside perspective view, partially in section, of the door, frame, and an exemplary embodiment of the present invention from FIG. 2.
Figure 4:
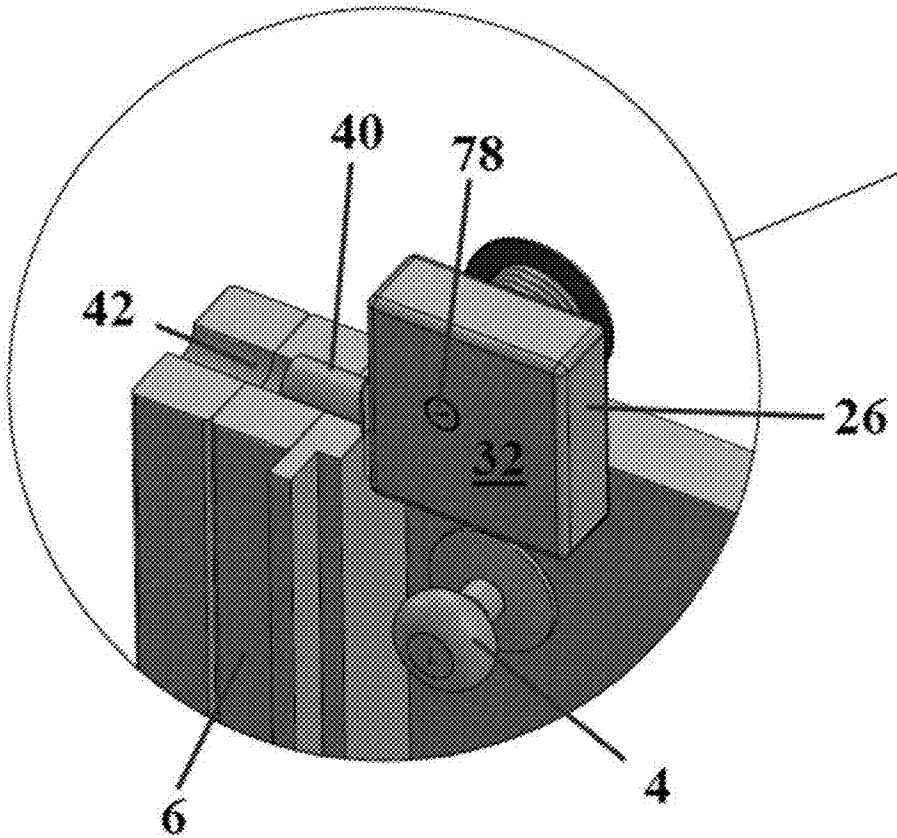
FIG. 4 is a broken-away, detail view of an exemplary embodiment of the present invention from FIG. 3.
Figure 6:
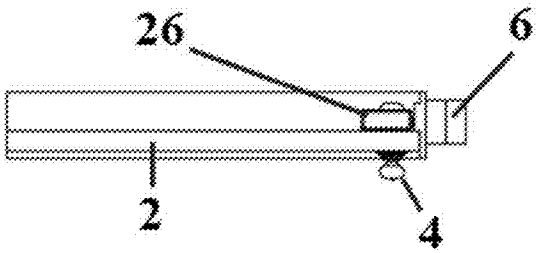
FIG. 6 is a broken-away, top perspective of the door, frame, and an exemplary embodiment of the present invention from FIG. 2.

Door 2 is closed, abutting stop surface 8, and key 80 is inserted into key hole 78, and turned to actuate deadbolt 36, so that the deadbolt 36 enters bolt opening 28 and contacts door frame 6. Bolt opening 28 is located forward of outside door surface 22 to ensure that deadbolt 36 is located and impacts an area of door frame 6 that is well-supported by the structure of the building, usually having at least two 2×4's abutting each other, as shown in FIGS. 2-4.

This spot where deadbolt 36 contacts door frame 6, is marked, and ferrule opening 42 (see FIGS. 1, 3, 4 and 6), is bored into the door frame 6 to receive ferrule 40 and deadbolt 36. This ferrule opening 42 is at least 2.5 inches and more preferably at least three inches deep. Once ferrule opening 42 is bored into door frame 6, ferrule 40 is inserted into ferrule opening 42 and secured to door frame 6 using screws 16 which are threaded into ferrule screw holes 46. Ferrule flange 44 secures ferrule 40 to door frame 6, operates as a strike plate for deadbolt 36, receives deadbolt 36 when actuated by turn knob actuator 72 and key lock actuator 82, and provides greater structural integrity for security device 20. This completes the installation of security device 20.

To lock door 2 from the inside, turn knob 70 is rotated, turn knob actuator 72 is engaged and deadbolt 36 slides into ferrule 40 which is secured to door frame 6. To unlock door 2 from the inside, turn knob 70 is rotated the other direction, and deadbolt 36 slides out of ferrule 40.

To lock door 2 from the outside, key 80 is inserted into key hole 78 and rotated, key lock actuator 82 is engaged and deadbolt 36 slides into ferrule 40 which is secured to door frame 6. To unlock door 2 from the outside, key 80 is inserted into key hole 78 and rotated, key lock actuator 82 is engaged and deadbolt 36 slides out of ferrule 40.

In this embodiment, there are two separate locking mechanisms mounted on housing 26: turn knob actuator 72, which projects inwardly from door 2 and key lock actuator 82, which projects outwardly of outside door surface 22.

An exemplary embodiment of security device 20 can be assembled as follows:

1. Place key cylinder 74 into housing opening 34 until key cylinder 74 engages outside housing face 32.
2. Place gear assembly teeth 52 into housing opening 34 in a lengthwise direction until gear assembly 50 engages key cylinder 74.
3. Insert deadbolt 36 into bolt opening 28.
4. Engage bolt notches 38 with gear assembly teeth 52 and insert deadbolt 36 completely into bolt opening 28.
5. Slide gear assembly housing flange 58 over gear assembly end 54 until gear assembly housing flange 58 engages inner housing face 30.
6. Secure gear assembly housing flange 58 to housing 26 by threading screws 16 through gear assembly flange holes 60 into housing holes 35.
7. Slide inner washer 64 over gear assembly housing end 62 until inner washer 64 engages inner housing face 30 and gear assembly housing flange 58.
8. Insert gear assembly housing end 62 into through opening 14 until inner housing face 30 and inner washer 64 abut outside door surface 22.
9. Mount outer washer 66 over gear assembly end 54 until outer washer 66 engages inside door surface 24.
10. Slide threaded ring 68 over gear assembly housing end 62 until threaded ring 68 engages outer washer 66.
11. Insert turn knob 70 into gear assembly housing end 62.
12. Close door 2 until door 2 abuts stop surface 8.
13. Rotate turn knob actuator 72 so that deadbolt 36 slides out of bolt opening 28 and deadbolt 36 impacts door frame 6 forward of outside door surface 22.
14. Mark the spot where deadbolt 36 impacts door frame 6.
15. Where door frame 6 has been marked, bore at least a 2.5 inch ferrule opening 42 into door frame 6 to receive ferrule 40 and deadbolt 36.
16. Insert ferrule 40 into ferrule opening 42.
17. Thread screws 16 through ferrule screw holes 46 and into door frame 6 until ferrule flange 44 is secured to and abuts door frame 6.

It should be noted that this describes only the particular, illustrated embodiment. Those of skill in the art will recognize that other choices could be made for the various components of security device 20 without departing from the scope of the invention.

The foregoing described embodiments are exemplary in nature and are not intended to limit the scope of the invention.

I claim:

1. A security device for securing a door, comprising:

a housing, said housing defining a lock opening forward of an outside face of said door and facing a door frame;

a deadbolt contained within said housing that can be extended through said lock opening to secure said door;

a key lock actuator contained within said housing and mechanically connected to said deadbolt; and a turn knob actuator, said turn knob actuator being mechanically connected to said deadbolt by an elongated projection located within said housing, wherein either the key lock actuator or the turn knob actuator can be used to cause said deadbolt to move from a locked position to an unlocked position or from an unlocked position to a locked position.

2. The security device of claim 1, wherein said housing is sized to be mounted on an outside face of said door and extending through a through opening sized to receive a standard lock.

3. The security device of claim 2, wherein said key lock actuator is mechanically connected to said deadbolt and actuated by inserting a key into a key hole and rotating said key, said key hole being accessible from an outside side of said door.

4. The security device of claim 3, wherein said turn knob actuator is mechanically connected to said deadbolt and actuated by rotating a turn knob attached to said turn knob actuator, said turn knob being accessible from an inside side of said door.

5. The security device of claim 1, further comprising a ferrule, said ferrule being adapted to be mounted in a door frame and one or more structural framing members surrounding said door, said ferrule being sized to receive said deadbolt when the door is closed and said deadbolt is in its locked position.

6. The security device of claim 5, wherein said deadbolt extends at least an inch into said ferrule mounted to the door frame.

7. A security device for securing a door mounted within a door frame, comprising:

a housing, said housing being sized to be mounted on an outside face of said door and to extend through a through opening in said door sized to receive a standard lock; said housing further defining a lock opening forward of the outside face of said door and facing the door frame;

a deadbolt contained within said housing that can be extended through said lock opening to secure said door to the door frame;

a key lock actuator contained within said housing, said key lock actuator being mechanically connected to said deadbolt such that said key lock actuator can be used to extend or retract said deadbolt by inserting a key into a key hole and rotating said key, said key hole being accessible from an outside side of said door; and a turn knob actuator, said turn knob actuator being mechanically connected by an elongated projection to said deadbolt such that said turn knob actuator can be used to extend or retract said deadbolt by rotating a turn knob attached to said turn knob actuator, said turn knob being accessible from an inside side of said door.

8. The security device of claim 7, further comprising a ferrule, said ferrule being adapted to be mounted in an aperture in the door frame and an aperture in one or more structural framing members surrounding said door, said apertures positioned forward of the outside face of said door, said ferrule being sized to receive said deadbolt when the door is closed and said deadbolt is extended.

9. The security device of claim 8, wherein said deadbolt extends in and out of said ferrule by actuating said key lock actuator.

10. The security device of claim 9, wherein said deadbolt extends in and out of said ferrule by actuating said turn knob actuator.

11. The security device of claim 10, wherein said deadbolt extends at least an inch into said ferrule mounted to the door frame.

12. A security device for securing a door, said door having outside and inside faces, top, bottom, left and right edges; defining a through opening extending from the inside face to the outside face; being mounted on a door frame, comprising:

a housing, said housing being sized to be mounted on the outside face of said door and to extend through a through opening sized to receive a standard lock; said housing further defining a lock opening forward of the outside face of said door and facing said frame;

a deadbolt contained within said housing that can be extended through said lock opening to secure said door; said deadbolt including a series of notches for engaging a gear assembly;

said gear assembly comprising a cylindrical end and a circular end opposite the cylindrical end; said circular end defining a series of gears that engage the series of notches of said deadbolt within said housing;

a key lock actuator, said key actuator being located within said housing and being mechanically connected to said deadbolt; said key lock actuator defining a key hole that faces outwardly from the door; said key lock actuator comprising said key hole and a key cylinder that engages said gear assembly; said key lock actuator being capable of being used to extend or retract said deadbolt;

an elongated projection, said elongated projection is sized to be mounted over said gear assembly; said elongated projection fixed to and projecting inwardly from said housing; said elongated projection extending through the through opening in said door;

a turn knob actuator, said turn knob actuator being affixed to an end portion of said elongated projection on the inside face of the door and being mechanically connected to said deadbolt; said turn knob actuator comprising an inner washer, an outer washer, a threaded ring, and a turn knob; said turn knob actuator being capable of being used to extend or retract said deadbolt; and a ferrule, said ferrule being adapted to be mounted in an aperture in said door frame and an aperture in one or more structural framing members surrounding said door; said apertures positioned forward of the outside face of said door, said ferrule being mounted to the frame by a flange; said ferrule being sized to receive said deadbolt when the door is closed and said deadbolt is extended; said deadbolt being extended in and out of said ferrule by actuating said key lock actuator; said deadbolt being extended in and out of said ferrule by actuating said bolt lock actuator; said deadbolt bolt extending at least an inch into said ferrule.

* * * * *